US005745875A

United States Patent [19]

Jackson et al.

[11] Patent Number: 5,745,875

[45] Date of Patent: Apr. 28, 1998

[54] STENOGRAPHIC TRANSLATION SYSTEM AUTOMATIC SPEECH RECOGNITION

[75] Inventors: Johnny Jay Jackson, Charleston, W. Va.; Brian Keith Bennett, Marietta, Ohio

[73] Assignee: Stenovations, Inc., Parkersburg, W. Va.

[21] Appl. No.: 422,025

[22] Filed: Apr. 14, 1995

[51] Int. Cl.[6] ..... G10L 3/00

[52] U.S. Cl. ..... 704/235; 704/255; 704/270; 400/86; 400/94

[58] Field of Search ..... 395/2.86, 2.4, 395/2.52, 2.64, 2.79, 2.44, 2.61, 2.53; 400/91, 86, 94; 178/21, 31; 364/419.15, 419.11; 369/25; 360/5, 4; 704/278

[56] References Cited

U.S. PATENT DOCUMENTS

| | | | |
|---|---|---|---|
| Re. 33,337 | 9/1990 | Lefler | 178/21 |
| 4,924,387 | 5/1990 | Jeppesen | 705/8 |
| 5,031,113 | 7/1991 | Hollerbauer | 395/2.44 |
| 5,202,952 | 4/1993 | Gillick et al. | 704/200 |
| 5,233,681 | 8/1993 | Bahl et al. | 704/251 |
| 5,272,571 | 12/1993 | Henderson et al. | 360/4 |
| 5,293,584 | 3/1994 | Brown et al. | 704/277 |
| 5,329,608 | 7/1994 | Bocchieri et al. | 395/2.52 |
| 5,500,920 | 3/1996 | Kupiec | 395/2.79 |
| 5,526,259 | 6/1996 | Kaji | 364/419.03 |
| 5,649,060 | 7/1997 | Ellozy et al. | 704/278 |

*Primary Examiner*—Allen R. MacDonald
*Assistant Examiner*—Donald L. Storm
*Attorney, Agent, or Firm*—Spencer D. Conard

[57] ABSTRACT

The present invention involves a stenographic translation system which comprises (a) a stenographic processor device for converting lexical stroke symbols to first output units comprising language text words and sets of undefined lexical stroke symbols; (b) a speech recognition system using clusters of speech word models of a vocabulary to define word output units from speech, the units each having a system clock time value; (c) an output controller for outputting defined words by matching the output units within a time window and selecting a final output word or undefined symbol. A method is provided wherein a human speaker makes an utterance which is received essentially simultaneously by a stenographer and a speech recognition system. The stenographer manually applies first inputs to keys in a stenographic processor device to generate first outputs by using a scan chart with translations to define a word output from the stenographic processor. The speech recognition system converts the utterances to a second output. The controller processes the outputs to provide words. The system permits updating of vocabulary dictionaries of the system.

8 Claims, 2 Drawing Sheets

32
100
28
102
36
100
PROCESSOR DEVICE
RECOGNITION SYSTEM
142
140
12
14
104
106
10
OUTPUT CONTROLLER
16
122

102
12
22
108
110
STROKE SYMBOL MEANS
TRANSLATOR MEANS
SCAN CHART MEMORY
18
104
112
20

100
14
30
114
116
TRANSFORMER
RECOGNIZER
STORED VOCABULARY
24
106
118
26

STENOGRAPHIC TRANSLATION SYSTEM AUTOMATIC SPEECH RECOGNITION

BACKGROUND OF THE INVENTION

1. Field of the Invention

The present invention relates to stenographic translation systems and methods, and more particularly relates to stenographic translation systems for translating a sequence of stroke symbols to language text and methods for stenographic translation.

2. Description of the Related Art

Stenographic translation systems which translate a sequence of stenographic stroke symbols to language text are known, see, for example, Lefler et al., U.S. Pat. No. 4,724,285, issued Feb. 9, 1988, which is incorporated herein by reference. Such translation systems are typically used in the course of taking depositions for court proceedings, and as such, the testimony is spoken, is heard by the court reporter, is recorded by stenographic strokes of the court reporter, and those strokes are translated into language text via a computer matching system wherein strokes are compared with a dictionary for matches, and the language text and undefined strokes are then reviewed by the court reporter for complete translation of the strokes into language text. Court reporters typically electronically record the verbal testimony in order to facilitate the reporter's completion of the translation of the strokes. A problem with such a system is the high levels of undefined words that can result if a reporter misstrokes (or fails to stroke) the keys of the stenotype machine. Misstrokes can result from numerous causes such as fatigue, speed of speech (utterances) or inexperience of the court reporter. These undefined strokes (or stroke combinations) can result in the need for the court reporter to spend an undesirably large amount of time deciphering and translating the undefined and/or unstroked key set out in the translation following the dictionary matching step.

Consequently, there is a need for a stenographic translation system and methods which will provide a reduced level of undefined strokes.

SUMMARY OF THE INVENTION

The present invention involves a stenographic translation system which comprises (a) a stenographic processor device having (i) stroke symbol means for providing a sequence of lexical stroke symbols, (ii) processor means for receiving the lexical stroke symbols from the stroke symbol means, the processor means comprising a scan chart memory storing a selected list of stroke symbol combinations and storing language text part translations of respective combinations, and combiner means for combining the language parts according to an identifier rule set to define complete words in language text format; (b) a speech recognition system having (i) a means for converting utterances to frame data sets and (ii) a resident vocabulary stored within a computer as clusters of word models, and (iii) a recognizer for matching data sets to resident vocabulary for defining complete words in language text format; (c) an output controller for outputting defined words. The system allows for decreased levels of undefined words.

DETAILED DESCRIPTION OF THE INVENTION

Figure 1:
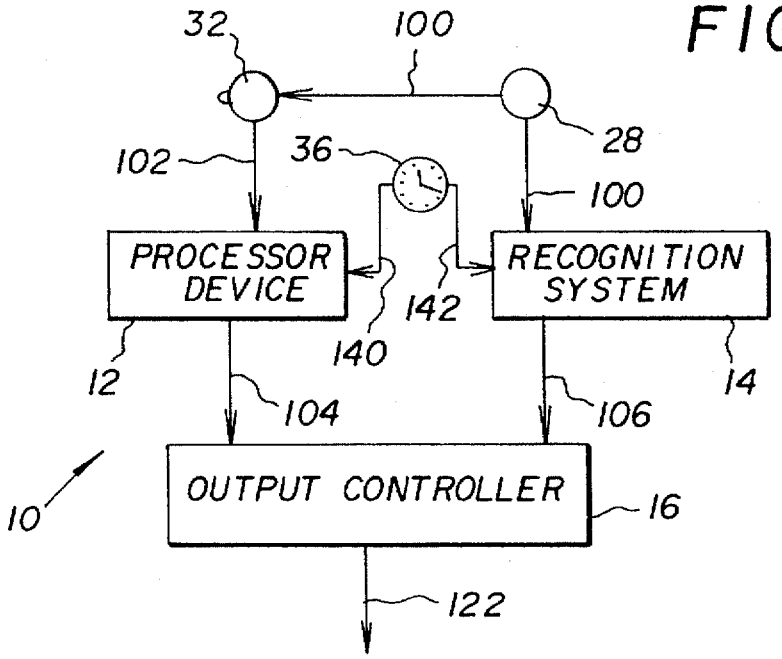
FIG. 1 is a schematic representation of the system of the present invention showing a stenographic processor device, a speech recognition system, and an output controller.

As shown in FIG. 1, the stenographic translation system (10) comprises (a) a stenographic processor device (12) for converting stenographic keystrokes into defined words, (b) a speech recognition system (14) for converting utterances into defined words, and (c) an output controller (16) for outputting defined words. The stenographic translation system (10) provides an output (122) having an enhanced level of defined words over a conventional stenographic processor device.

Figure 2:
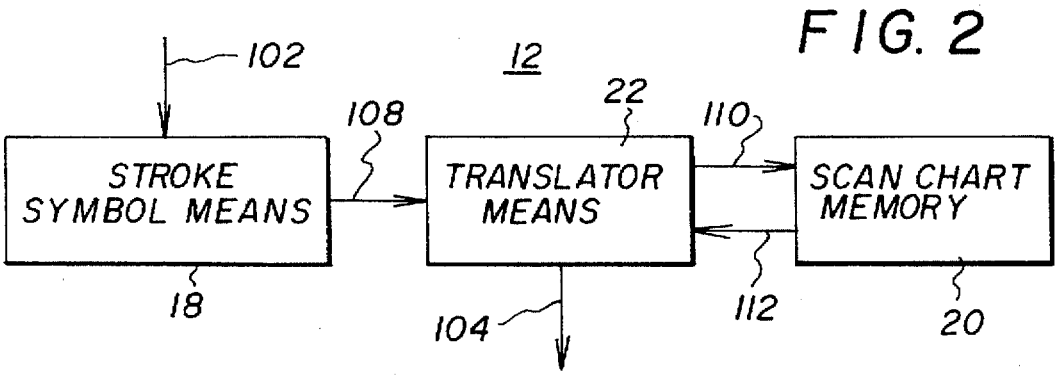
FIG. 2 is a schematic representation of the stenographic processor device set out in FIG. 1.

Stenographic processor devices for converting stenographic keystrokes are known, see Lefler et al., U.S. Pat. No. 4,724,285, issued Feb. 9, 1988, entitled "Stenographic Translation System" which is incorporated herein by reference. Other suitable systems include the TOMCAT device. As used in the Lefler et al. patent, the "stenotranslation system" would be suitable as a stenographic processor device (12) in the present invention. The stenographic processor device (12) translates lexical stroke symbols into language text format in accordance with a stenographic methodology, which is either predefined or is modified to the preferences of the given stenographer, wherein each lexical stroke symbol is defined by at least one character from a character set comprising consonants and vowels. As shown in FIG. 2, the stenographic processor device (12) preferably comprises (a) stroke symbol means (18) for providing a sequence of lexical stroke symbols, each lexical stroke comprising at least one vowel character and at least one consonant character; (b) a scan chart memory (20) for storing a selected list of chart entries comprising lexical stroke symbols and combinations of lexical stroke symbols and language text parts associated therewith for defining a translation of the chart entry, and (c) a translator means (22) for matching selected lexical stroke symbols for the stroke symbol means with chart entries from the scan chart memory (20) to define language parts and means for combining the language parts according to combination rules to define a translation in language text format to provide a first output (104) comprising units of (i) language text words and (ii) sets of undefined lexical stroke symbols. Various rules and related theories exist for the combination of language parts, each theory or rule set has advantages and disadvantages.

Speech recognition systems for converting utterances to language text are known, see Brown et al., U.S. Pat. No. 5,293,584, issued Mar. 8, 1994, entitled "Speech Recognition System for Natural Language Translation"; Gillick et al, U.S. Pat. No. 5,202,952, issued Apr. 13, 1993, entitled "Large-Vocabulary Continuous Speech Prefiltering and Processing System"; Bahl et al., U.S. Pat. No. 5,233,681, issued Aug. 3, 1993, Baker et al., U.S. Pat. No. 4,783,803, issued Nov. 8, 1988, Gillick et al., U.S. Pat. No. 4,837,831, issued Jun. 6, 1989, Gillick et al., U.S. Pat. No. 4,903,305, issued Feb. 20, 1990, Baker et al., U.S. Pat. No. 4,805,219, issued Feb. 14, 1989, and Baker et al., U.S. Pat. No. 4,803,729, issued Feb. 7, 1989, all of which are incorporated herein by reference.

Figure 3:
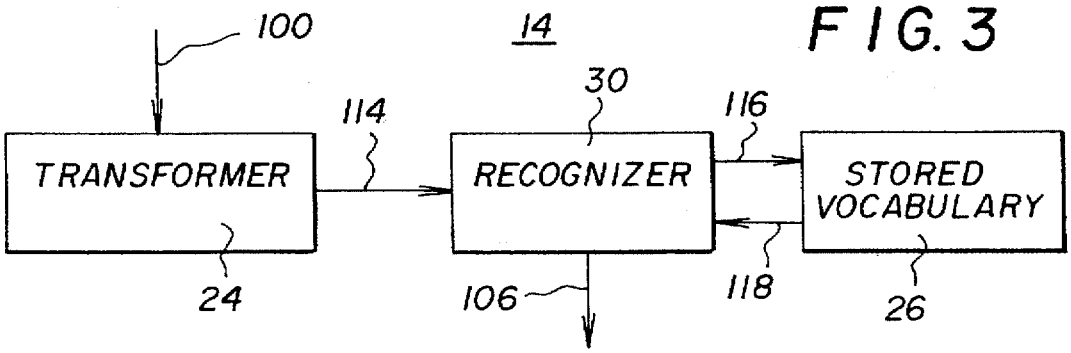
FIG. 3 is a schematic representation of the speech recognition system set out in FIG. 1.

As shown in FIG. 3, the speech recognition system (14) preferably includes (i) a transformer (24) for transforming utterances into word model data and (ii) a stored vocabulary (26) of word models. For a given speaker (28), the speaker (28) may be asked to first read a prepared amount of text to create a portion of the stored vocabulary, or previously recorded utterances may be used to create a portion of the stored vocabulary (26). Preferably, utterances are segmented and processed with respect to the vocabulary to generate a subset of word models to define a list of candidate words. Preferably, the word models are clustered, and cluster scores are utilized to identify the most likely cluster. Candidate words are then unpacked from the clusters and outputted in language text form. The speech recognition system (14) further comprises a recognizer (30) which provides word definitions of word model data by recognizing matches between the word model data and the stored vocabulary (26) to provide a second output (106) comprising units of (i) language text words and (ii) textural symbols to indicate undefined utterances.

Figure 4:
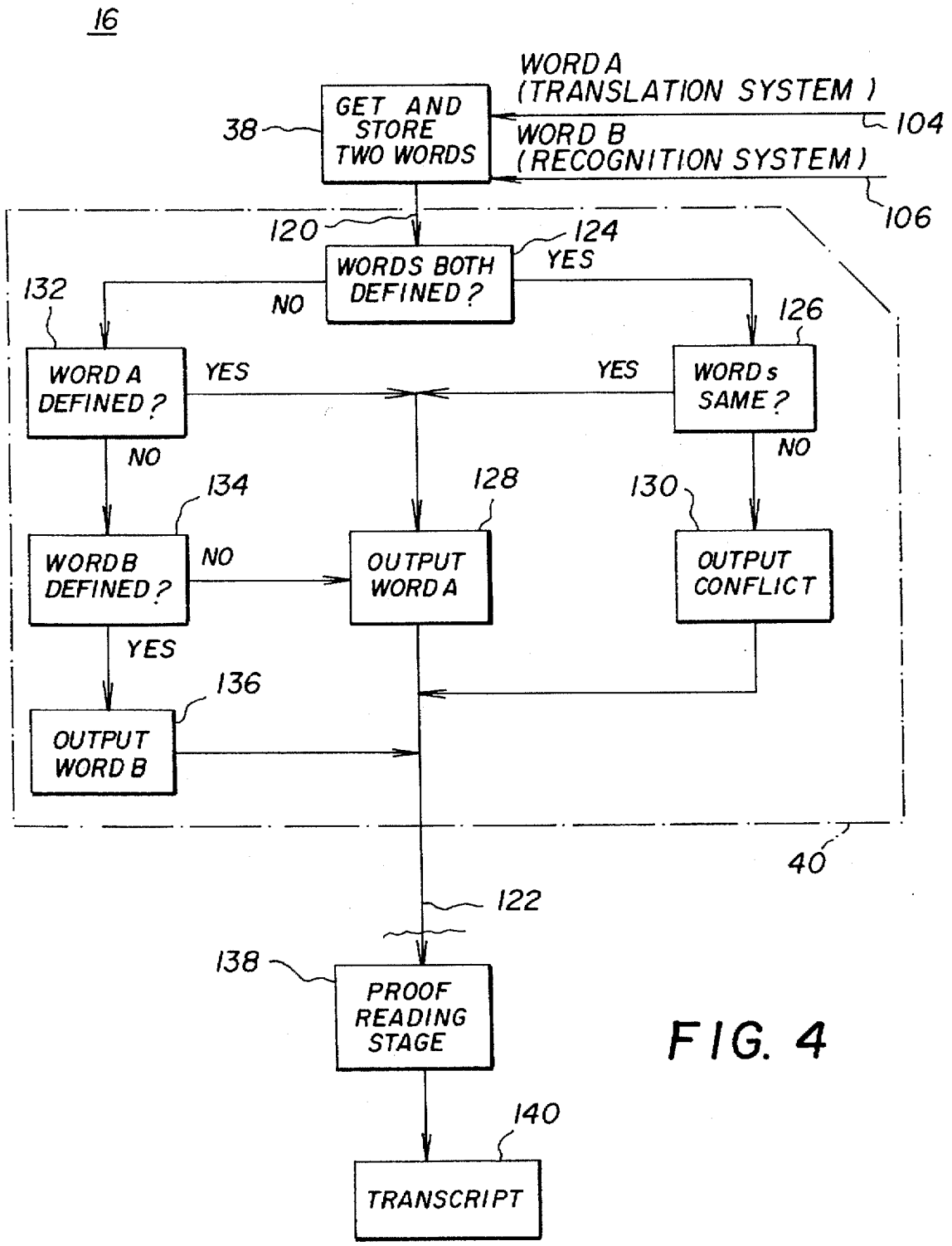
FIG. 4 is a schematic representation of the output controller set out in FIG. 1.

The language text output (104) of the stenographic processor device is preferably in the form of individual textural words where defined and in the form of a set of stenographic stroke symbols where undefined, wherein each word and set is outputted with a time value from a system clock (36). Similarly, the speech recognition system (14) outputs language text which is preferably in the form of individual textural words where defined and in the form of a symbol to indicate an undefined utterance where undefined, wherein each word and symbol is outputted with a time value from the system clock (36). As with all the stenographic processor devices which rely on the use of a human stenographer (32) to convert spoken utterances into stenographic keystrokes, there is typically a time delay of between 0.25 seconds and 5 seconds from the time of the utterance (100) until the time of the keystroke. Likewise, the speech recognition device takes time to translate utterances to text and time clock values for the output therefrom may be 0.25 to 5 seconds from the time of the utterance. Consequently, the clock time values for any given word definition output (104) from the stenographic processor device (12) may be greater or less than (indicating the time difference of 0.00 seconds to 5 seconds (for example, 0.01 to 4.75 seconds)) the clock time value for the corresponding word definition output (106) of the speech recognition device (14). The output time differences require that a time window be utilized for matching purposes. Various matching systems may be employed, and preferably matching is achieved by treating the stenographic processor device (12) output (104) as a matching key word and searching for a match in the speech recognition output (106) within the time window (suitable time windows may be the output (104) time value plus and minus 15 seconds, 30 seconds or 60 seconds for the output (106) word time values. Word matching systems are known, see Shimada et al., U.S. Pat. No. 5,210,868, issued May 11, 1993, which is incorporated herein by reference. Where words are matched within a time window, then the words/symbols/stroke sets which are unmatched are paired off where there are equal numbers of outputs between the word matches, and the undefined outputs between the matches are paired. Where the stenographic processor device and speech recognition system undefined outputs between the word matches are unequal in number, then the stenographic outputs are paired sequentially with speech recognition outputs to provide output pairs. Where an unequal number of outputs are present between word matches, then the outputs are paired sequentially and the excess unpaired outputs are paired with indicators to indicate the unpaired nature of the output. FIG. 4 illustrates the stage (38) of providing output pairs from the output (104) and output (106). The output word pairs (the term word pairs broadly includes any combination of word/stroke set/symbol pairs) are then preferably processed by the output controller (16) as follows: at stage (124) are both words defined? If yes, then at stage (126) are both words the same? If yes, then at stage (128) output the stenographic processor device defined, word (the defined word from output (104)), then repeat by going to stage (38). If at stage (124) both words are not defined, then proceed with the word pair to stage (132), and if at stage (132) the stenographic word (originally from output 104)) is defined then the defined word is outputted at stage (128) as system output (122), and proceed to (38) above. If at stage (132) the stenographic word is undefined then at stage (134) if the speech recognition device word is defined then at stage (136), the speech recognition device word (originally from 106) is outputted as system output (122) and proceed to stage (38) above. If at stage (134) the speech recognition device word is undefined then output as the system output (122) the stenographic stroke symbols corresponding to the undefined words, and proceed to (38) above. When no more word pairs are present for processing (at stage (38)), then the process is completed. If at stage (124) both words are defined, then proceed to stage (126) and if both words are not the same then proceed to stage (130) and the word pair is outputted as a conflict as system output (122).

A method is also provided wherein a human speaker (28) makes an utterance (100) which is received essentially simultaneously by a stenographer (32) and a speech recognition system (14). The stenographer manually applies forced inputs (102) to keys of the stenographic processor device (12). The stenographic processor device (12) provides a first output (stream) (104) comprising (i) words in language text format and (ii) lexical stenographic stroke symbols. The speech recognition system (14) receives utterances (100) and converts them to a second output (106) comprising individual text words and symbols. The first output (104) and second output (stream) (106) are input into the output controller (16) which matches units of the outputs (104, 106) to provide defined words where either the first output unit or the second output unit is a word, and provides lexical stroke symbols where neither the first output unit nor the second output unit is a word. The stenographic processor device (12) receives the forced inputs (102) and outputs lexical symbols (108) to translator means (22) which is in communication with scan chart memory (20) for requesting (110) and receiving (112) symbol set definitions corresponding to the symbols (108), and providing a word output where a definition was found and providing a symbol set where no word definition was found. The speech recognition system (14) receives an utterance (100) which is converted by transformer (24) into word data (114) and is transmitted to the recognizer (30) which requests (116) and receives (118) word data definitions from stored vocabulary (26). The recognizer (30) provides second output (106) which comprises words corresponding to the utterance and symbols corresponding to undefined word data. The stenographic translation system (10) has a system clock (36) which provides time information (140, 142) to the stenographic processor device (12) and speech recognition system (14) respectively. Time indexing of words, video and text is generally well known. See Jeppesen, U.S. Pat. No. 4,924,387, issued May 8, 1990, which is incorporated herein by reference. The first output (104) and second output (106) comprise units which have been assigned time values based on the system clock (36). The output controller (16) utilizes these time values to restrict the window or windows of first output (104) and/or second output (106) in which to search for a match.

As shown in FIG. 4, the output controller (16) receives first output units (104) and second output units (106) and at stage (38) seeks to find a match (pair) of units within a time window as set out above. Also, as set out above, the time value for a first output unit will likely be slightly greater than or slightly less than the time value for the corresponding second output unit. The output controller comprises a matching means (38) (also referred to as stage (38)) for matching first output units and second output units within a relative time window to provide unit pairs (120). The unit pairs (120) are then processed by prioritizing means (40) for prioritizing the unit components of unit pairs (120) for final output (122). The prioritizing means (40) preferably evaluates both units of the unit pair (120) to determine if both units are defined as words at stage (124), if yes then the units are compared to see if they are the same word at stage (126), and if they are then the unit from the first output (104) is utilized as an output word unit (128) for the final output (122). If the units at stage (126) are not the same word, then the conflicting units are output as a conflicting pair (130) for final output (122). If at stage (124) both units of pair (120) are not defined then at stage (132) if the unit of the first output (104) is defined then it is utilized as the output word unit (128) for final output (122). If at stage (132), the first output (104) unit of the unit pair (120) is undefined, then at stage (134) if the second output (106) unit of the pair (120) is defined as a word then that word is utilized as the output unit (134) for final output (122). If at stage (134), the second output (106) unit of unit pair (120) is undefined then the lexical stroke symbols of the first output (104) are utilized for final output (122). As set out above for prioritizing means (40), the final output (122) will comprise words, pairs of words in conflict, and undefined lexical stroke symbols. The stenographer (32) can then proofread the final output (122) at the proofreading stage (138), which can be on display in a stenographic word processor, and can be based on the context of the final output (122), resolve word conflicts and provide translations for the undefined lexical stroke symbols, and the proofread textual transcript (140) of the utterances may finally output. Preferably, as multiple users use the systems, then users may share and update dictionaries for their respective speech recognition systems. For example, if the system is being used for court reporting, then a lawyer who has previously had utterances recognized by the speech recognition system could provide a base dictionary to the court reporter, and the court reporter could provide the lawyer with an updated dictionary after having transcribed addition utterances from the lawyer. Suitable means for the stages (38 and 124–136) may involve computer hardware in combination with software or may be hard wired in a suitable fashion.

The invention claimed is:

1. A stenographic translation system, comprising:

(a) a stenographic processor device for converting lexical stroke symbols to a first output having a time value, said first output comprising units of (i) language text words and (ii) sets of undefined lexical stroke symbols, (b) a speech recognition system for converting utterance to a second output having a time value, said second output comprising units of (i) language text words and (ii) textual symbols to indicate undefined utterances, (c) means for matching units of said first output with corresponding units of said second output within a time window to provide paired units, and (d) outputting means for processing said paired units for outputting from each paired unit a unit selected from the group consisting of language text words and sets of undefined lexical stroke symbols.

2. The stenographic translation system of claim 1 wherein said units have corresponding system clock time values to facilitate matching thereof.

3. The stenographic translation system of claim 1 wherein said stenographic processor device comprises (i) stroke symbol means for providing a sequence of lexical stroke symbols, (ii) a scan chart memory for storing a selected list of lexical stroke symbols and language text parts associated with (A) the lexical stroke symbols and (B) combinations of the lexical stroke symbols, and (iii) a translator means for matching selected lexical stroke symbols from the stroke symbol means with entries from the scan chart memory to define language parts and means for combining the language parts to define a translation in language text format.

4. The stenographic translation system of claim 1 wherein said speech recognition system comprises (i) a stored vocabulary of word models, (ii) means for converting utterances into word models, and (iii) means for matching the converted utterance word models with the vocabulary word models to provide said second output.

5. The stenographic translation system of claim 1 wherein speech recognition device comprises a dictionary, said stenographic translation system comprising means for updating said dictionary by using the outputted language text words from the stenographic translation system.

6. A method for providing a stenographic translation of utterances, said method comprising:

(a) providing stenographic key strokes corresponding to said utterances, (b) translating said strokes into first units comprising words in language text format and undefined lexical stroke sets, (c) providing word models corresponding to said utterances, (d) translating said word models into second units comprising words in language text formats an textual symbols to indicate undefined utterances, (e) matching said first units with said second units to provide pairs of corresponding units, (f) outputting a word from each pair comprising a word.

7. The method of claim 6 comprising outputting at least one lexical stroke for pairs comprising a first unit wherein the pair is free of words.

8. The method of claim 6 wherein said first and said second unit each have a system clock time value associated therewith to facilitate matching of said first unit and said second unit.

* * * * *